US008043237B1

(12) United States Patent
Wu

(10) Patent No.: US 8,043,237 B1
(45) Date of Patent: Oct. 25, 2011

(54) MASSAGING DEVICE HAVING COMPLETELY MASSAGING EFFECT

(76) Inventor: Dong-Her Wu, Chang Hua Hsien (TW)

( * ) Notice: Subject to any disclaimer, the term of this patent is extended or adjusted under 35 U.S.C. 154(b) by 887 days.

(21) Appl. No.: 12/053,195

(22) Filed: Mar. 21, 2008

(51) Int. Cl.
*A61H 11/00* (2006.01)

(52) U.S. Cl. ..... 601/143; 601/144; 601/146

(58) Field of Classification Search ..... 601/11–113, 601/116, 124, 134, 136, 138, 143, 144, 146, 601/147; 482/51
See application file for complete search history.

(56) References Cited

U.S. PATENT DOCUMENTS 4,991,568 A * 2/1991 Lin ..... 601/101
7,883,484 B1 * 2/2011 Wu ..... 601/144
2004/0073146 A1 * 4/2004 Weintraub et al. ..... 601/134
2006/0009720 A1 * 1/2006 Chung ..... 601/143
2006/0074361 A1 * 4/2006 Zicherman ..... 601/144

* cited by examiner

*Primary Examiner* — Quang D Thanh
(74) *Attorney, Agent, or Firm* — Alan Kamrath; Kamrath & Associates PA

(57) ABSTRACT

A massaging device includes a support member, a massaging member movably mounted on the support member, two opposite connecting straps connected with the massaging member respectively, two massaging belts each connected with a respective one of the connecting straps, a drive member mounted on the support member and provided with a rotation shaft, and an eccentric member rotatable with the rotation shaft and provided with an eccentric shaft to drive the massaging member to move relative to the support member. Thus, the massaging member is movable to massage the user's back reciprocally, and the two massaging belts are movable to massage the user's body reciprocally, so that the massaging device can be used to massage the user's body exactly and completely.

20 Claims, 10 Drawing Sheets

MASSAGING DEVICE HAVING COMPLETELY MASSAGING EFFECT

BACKGROUND OF THE INVENTION

1. Field of the Invention

The present invention relates to a massaging device and, more particularly, to a massaging device to provide a massaging effect to a user.

2. Description of the Related Art

A conventional massaging device in accordance with the prior art shown in FIGS. 9 and 10 comprises a hollow cushion 50, a support frame 51 mounted in the cushion 50, and a massaging mechanism 60 mounted on the cushion 50 and supported by the support frame 51. The massaging mechanism 60 includes a motor 62 mounted on the support frame 51 and provided with a rotation shaft 63, and two eccentric units 64 mounted on two opposite ends of the rotation shaft 63 of the motor 62 respectively. Each of the eccentric units 64 includes an eccentric member 641 having a first end mounted on the respective end of the rotation shaft 63 of the motor 62, a rotation member 642 mounted on a second end of the eccentric member 641 by a bearing 643, and a fastening belt 61 having a first end mounted on the rotation member 642 and a second end provided with a bonding portion 611. In operation, the eccentric units 64 of the massaging mechanism 60 are driven by the rotation shaft 63 of the motor 62 to provide a massaging effect to a user. However, the massaging mechanism 60 is used to massage a small part of the user's body only, thereby limiting the massaging effect of the massaging device.

BRIEF SUMMARY OF THE INVENTION

In accordance with the present invention, there is provided a massaging device, comprising a support member, a massaging member movably mounted on the support member, two opposite connecting straps connected with the massaging member respectively, two massaging belts combined with each other and each connected with a respective one of the two connecting straps, a drive member mounted on the support member and provided with a rotation shaft, and an eccentric member mounted on and rotatable with the rotation shaft of the drive member and provided with an eccentric shaft connected with the massaging member to drive the massaging member to move relative to the support member by rotation of the eccentric member.

The primary objective of the present invention is to provide a massaging device having a completely massaging effect.

Another objective of the present invention is to provide a massaging device, wherein the massaging member is movable to massage the user's back reciprocally, and the two massaging belts are movable to massage the user's body reciprocally, so that the massaging device can be used to massage the user's body exactly and completely, thereby enhancing the massaging effect of the massaging device, and thereby providing comfortable sensation to the user.

A further objective of the present invention is to provide a massaging device, wherein the user's body is encircled by the two massaging belts, the two connecting straps and the massaging member, so that the user's body is pulled, rubbed, twisted and kneaded by movement and deflection of the two massaging belts, the two connecting straps and the massaging member, thereby greatly enhancing the massaging effect of the massaging device.

A further objective of the present invention is to provide a massaging device, wherein the massaging member can be used to massage the user's back, and the two massaging belts can be used to massage the user's waist and abdomen, thereby enhancing the versatility of the massaging device.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
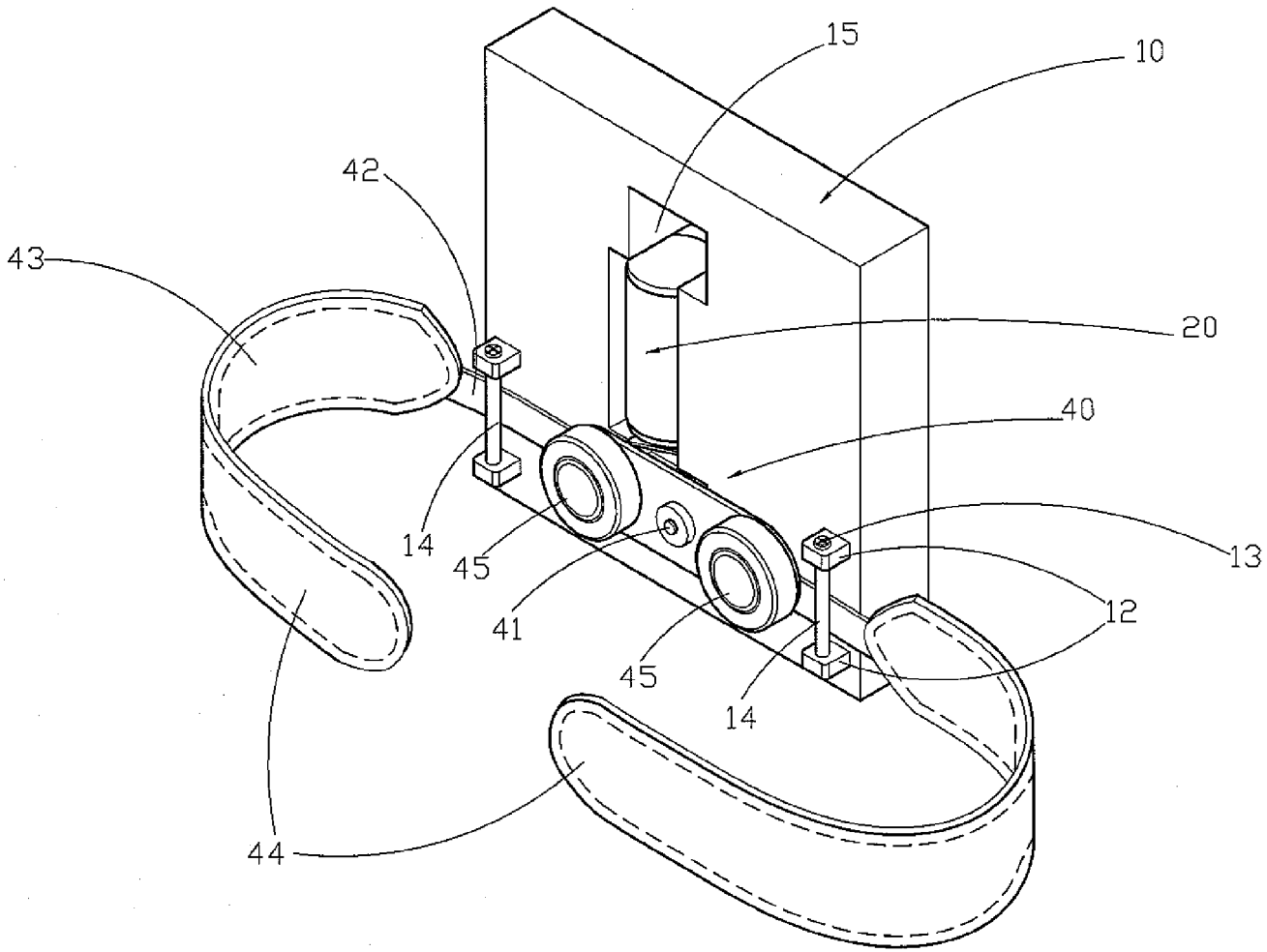
FIG. 1 is a perspective view of a massaging device in accordance with the preferred embodiment of the present invention.

Referring to the drawings and initially to FIGS. 1-6, a massaging device in accordance with the preferred embodiment of the present invention comprises a support member 10, a massaging member 40 movably mounted on the support member 10, two opposite connecting straps 42 connected with the massaging member 40 respectively, two massaging belts 43 combined with each other and each connected with a respective one of the two connecting straps 42, a drive member 20 mounted on the support member 10 and provided with a rotation shaft 21, an eccentric member 30 mounted on and rotatable with the rotation shaft 21 of the drive member 20 and provided with an eccentric shaft 31 connected with the massaging member 40 to drive the massaging member 40 to move relative to the support member 10 by rotation of the eccentric member 30, and two support rods 14 each mounted on the support member 10 and each abutting a respective one of the two connecting straps 42.

The support member 10 is made of a soft cushion. The support member 10 has a mediate portion provided with a receiving recess 15 located between the two support rods 14 to receive the drive member 20 and the eccentric member 30. The support member 10 has two opposite ends each provided with two spaced support blocks 12 to support a respective one of the two support rods 14. The massaging device further comprises two positioning bolts 13 each extending through the respective support blocks 12 of the support member 10 and the respective support rod 14 to position the respective support rod 14 between the respective support blocks 12 of the support member 10. Each of the two support rods 14 is a hollow body and is rotatably mounted between the respective support blocks 12 of the support member 10. Each of the two support rods 14 is used to limit movement of the respective connecting strap 42.

The drive member 20 includes a gear unit engaged with the rotation shaft 21 to rotate the rotation shaft 21, and a motor connected with the gear unit to drive the gear unit. The gear unit includes a reduction gear to increase the torque of the drive member 20.

The massaging member 40 is located between the two support rods 14. The massaging member 40 has a middle portion provided with a driven hole 41 which has a stepped shape. The massaging member 40 has a surface provided with two spaced massaging rolls 45, and the driven hole 41 of the massaging member 40 is located between the two massaging rolls 45.

Each of the two connecting straps 42 is movable between the support member 10 and the respective support rod 14 and has a first end connected with one of two opposite ends of the massaging member 40.

The two massaging belts 43, the two connecting straps 42 and the massaging member 40 form a loop when the two massaging belts 43 are combined with each other. Each of the two massaging belts 43 is located outside of the respective support rod 14. Each of the two massaging belts 43 has a first end connected with a second end of the respective connecting strap 42 and a second end provided with an adjustable bonding portion 44. The adjustable bonding portions 44 of the two massaging belts 43 are combined with each other by bonding, snapping, adhesive and the like.

The eccentric member 30 has a first end secured on and rotatable with the rotation shaft 21 of the drive member 20 and a second end provided with the eccentric shaft 31. The first end of the eccentric member 30 is provided with a mounting hole 33 mounted on the rotation shaft 21 of the drive member 20. The eccentric shaft 31 of the eccentric member 30 has an axial direction spaced from and parallel with that of the rotation shaft 21 of the drive member 20. The eccentric shaft 31 of the eccentric member 30 is rotatably mounted in the driven hole 41 of the massaging member 40 to move the massaging member 40 by rotation of the eccentric member 30.

The massaging device further comprises a bearing 32 mounted in the driven hole 41 of the massaging member 40 and located between the massaging member 40 and the eccentric shaft 31 of the eccentric member 30, and a bushing 22 mounted in the mounting hole 33 of the eccentric member 30 and located between the eccentric member 30 and the rotation shaft 21 of the drive member 20.

Figure 2:
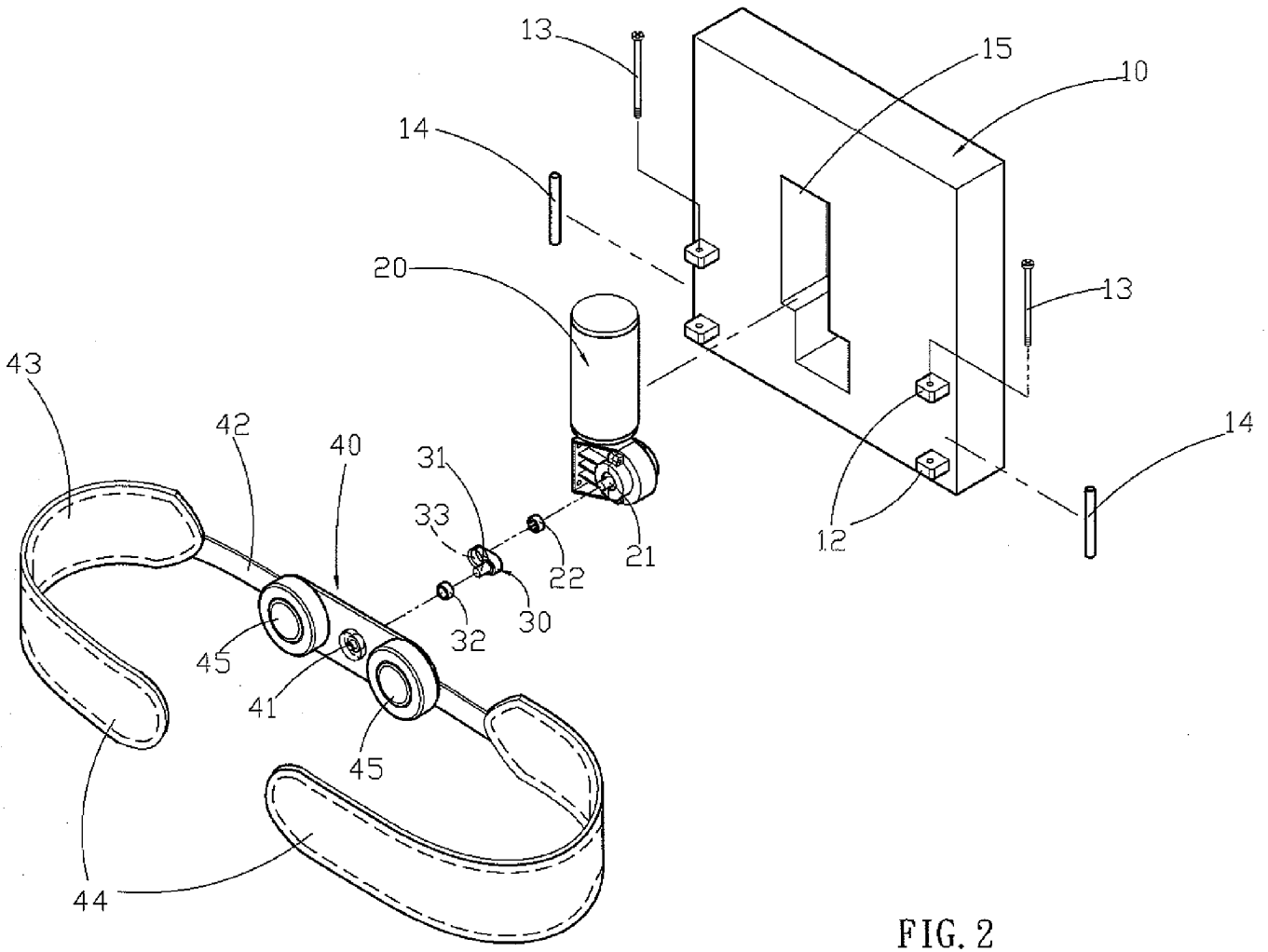
FIG. 2 is an exploded perspective view of the massaging device as shown in FIG. 1.
Figure 3:
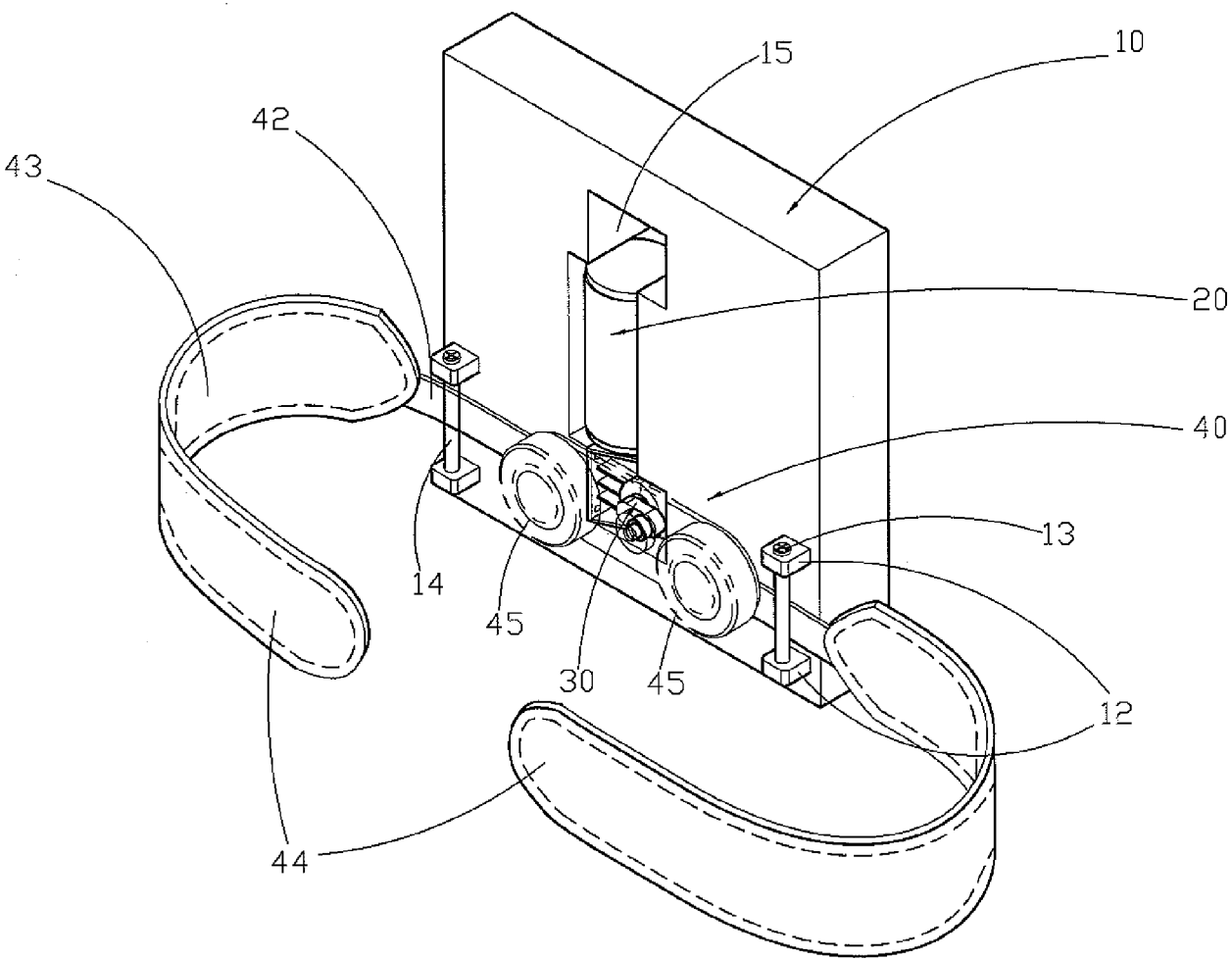
FIG. 3 is another perspective view of the massaging device as shown in FIG. 1.
Figure 4:
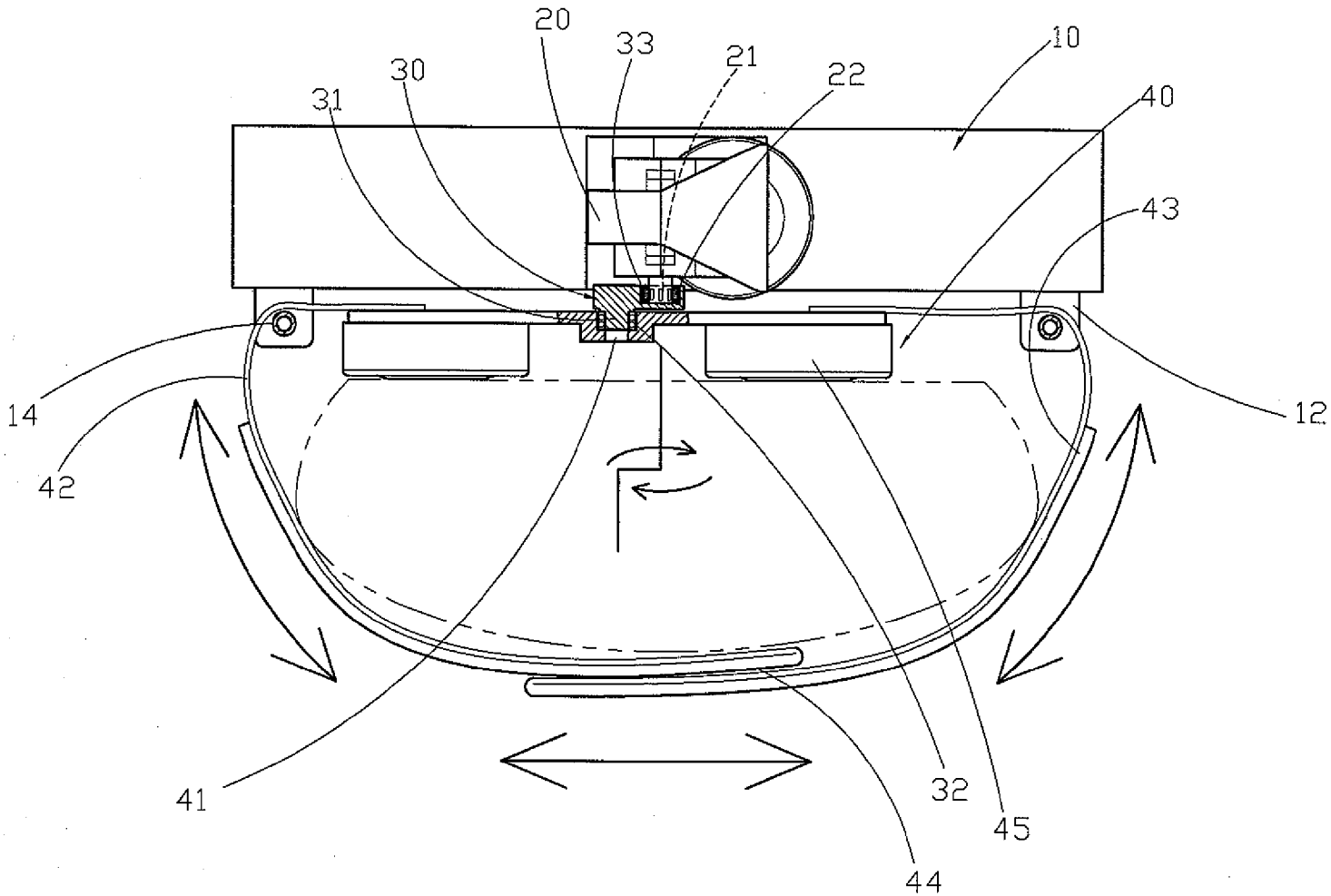
FIG. 4 is a top cross-sectional view of the massaging device as shown in FIG. 1.
Figure 5:
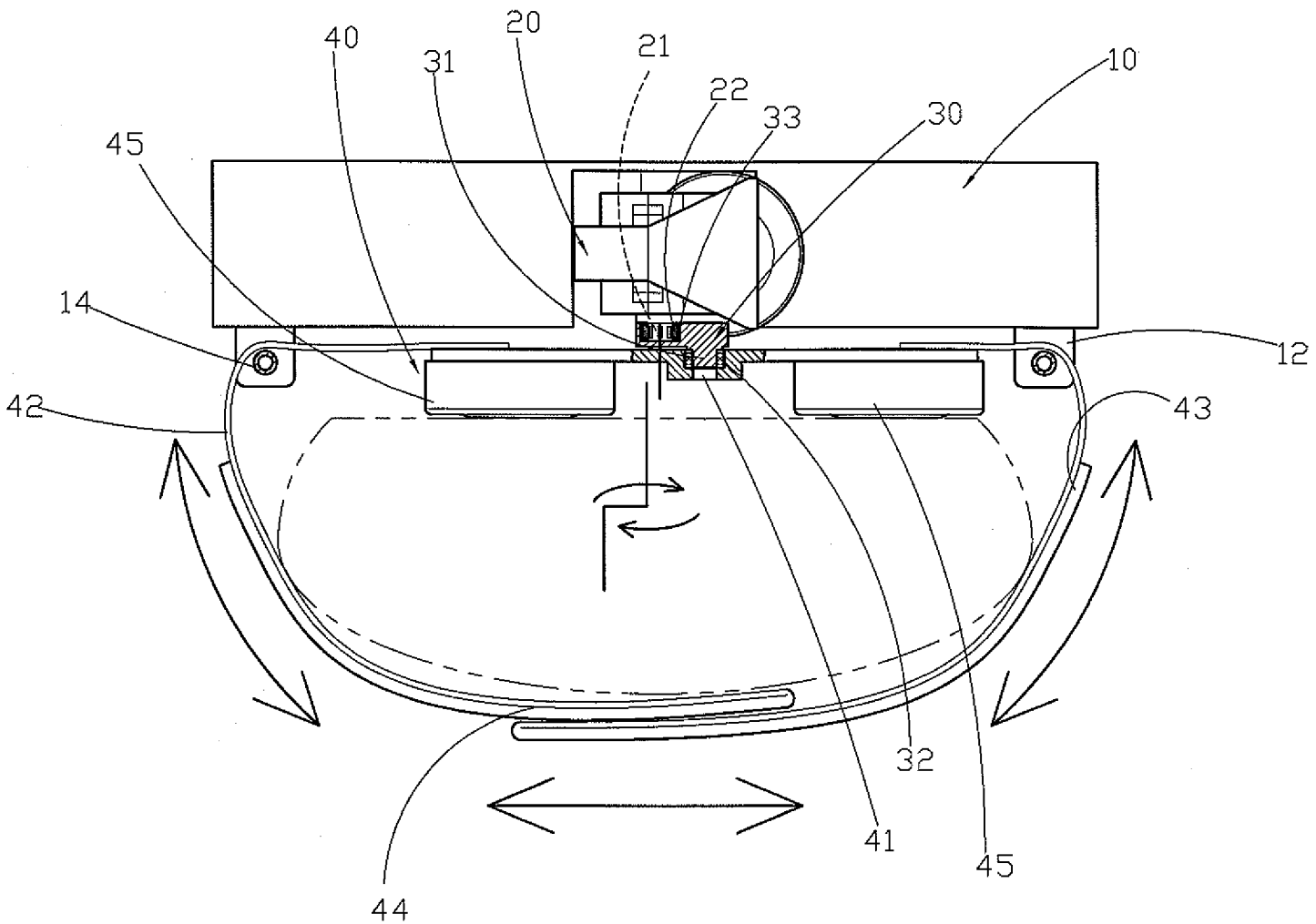
FIG. 5 is a schematic operational view of the massaging device as shown in FIG. 4.

In operation, referring to FIGS. 4 and 5 with reference to FIGS. 1-3, when the two massaging belts 43 are combined with each other, the two massaging belts 43, the two connecting straps 42 and the massaging member 40 form a loop to encircle a user's body. At this time, the user's back abuts the two massaging rolls 45 of the massaging member 40. When the rotation shaft 21 of the drive member 20 is rotated, the eccentric shaft 31 of the eccentric member 30 is rotated eccentrically to drive the massaging member 40 to move and deflect rightward and leftward relative to the support member 10 in a reciprocal manner as shown in FIGS. 4 and 5, so as to massage the user's back reciprocally.

Figure 6:
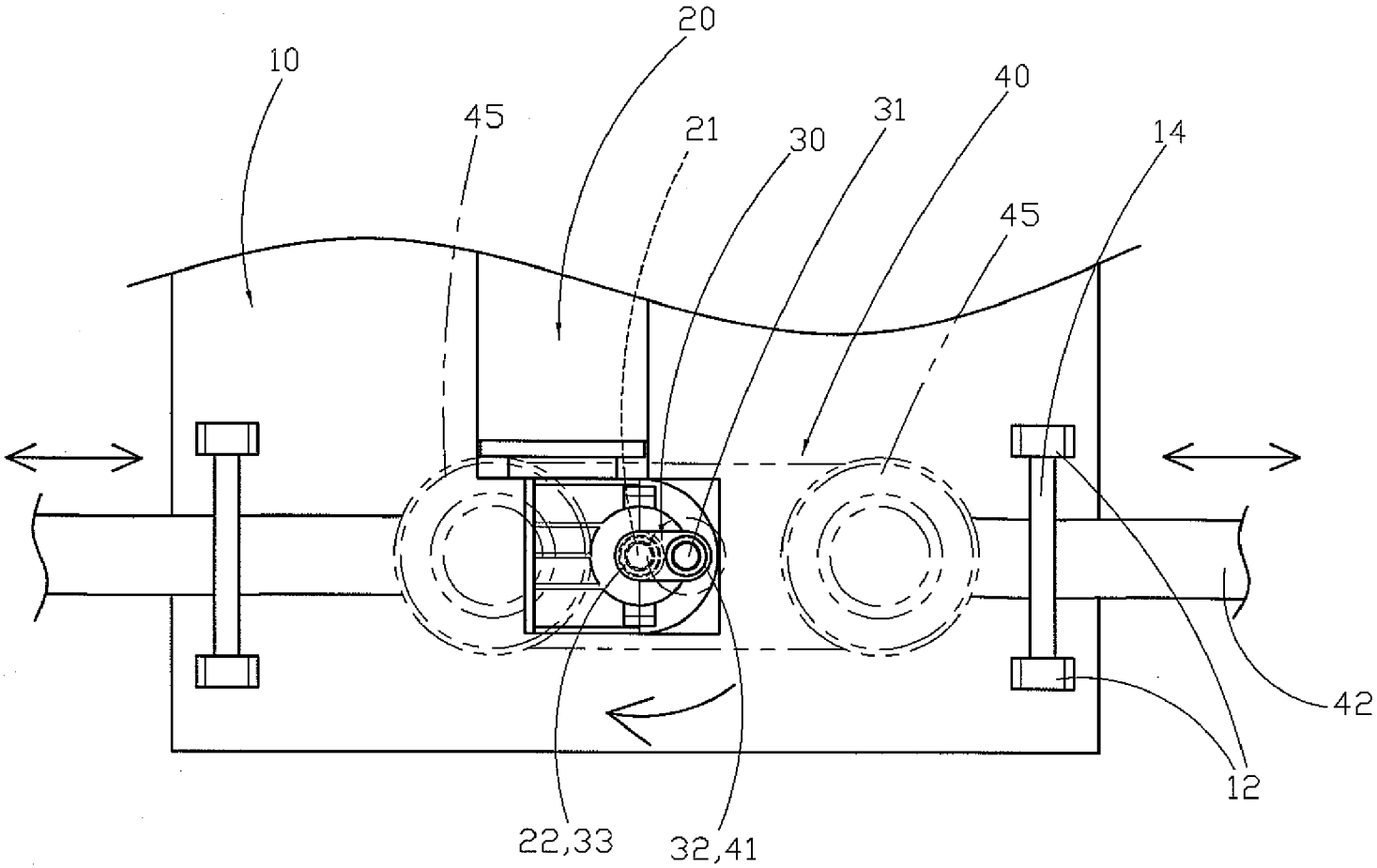
FIG. 6 is a front cross-sectional view of the massaging device as shown in FIG. 1.
Figure 7:
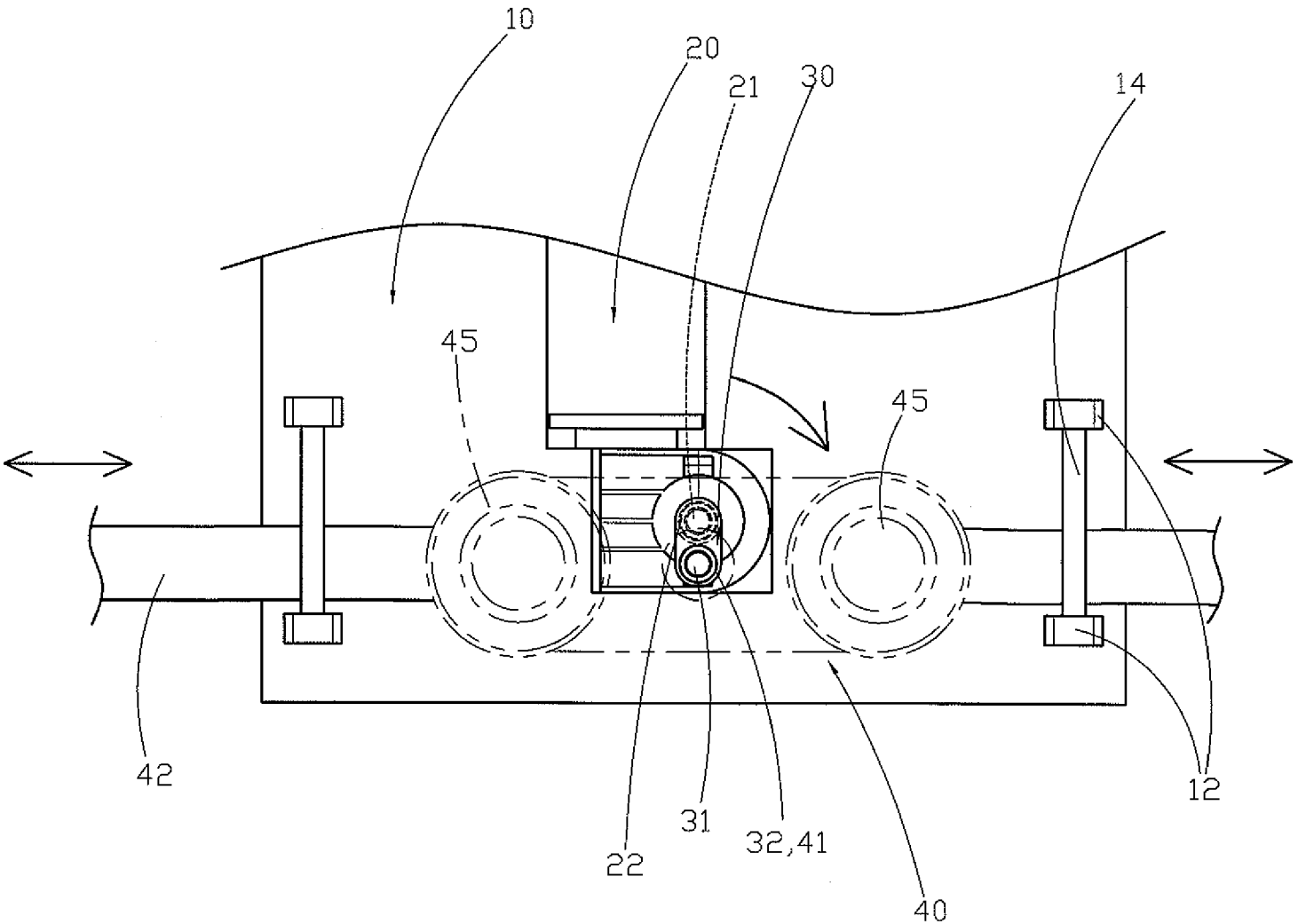
FIG. 7 is a schematic operational view of the massaging device as shown in FIG. 6.
Figure 8:
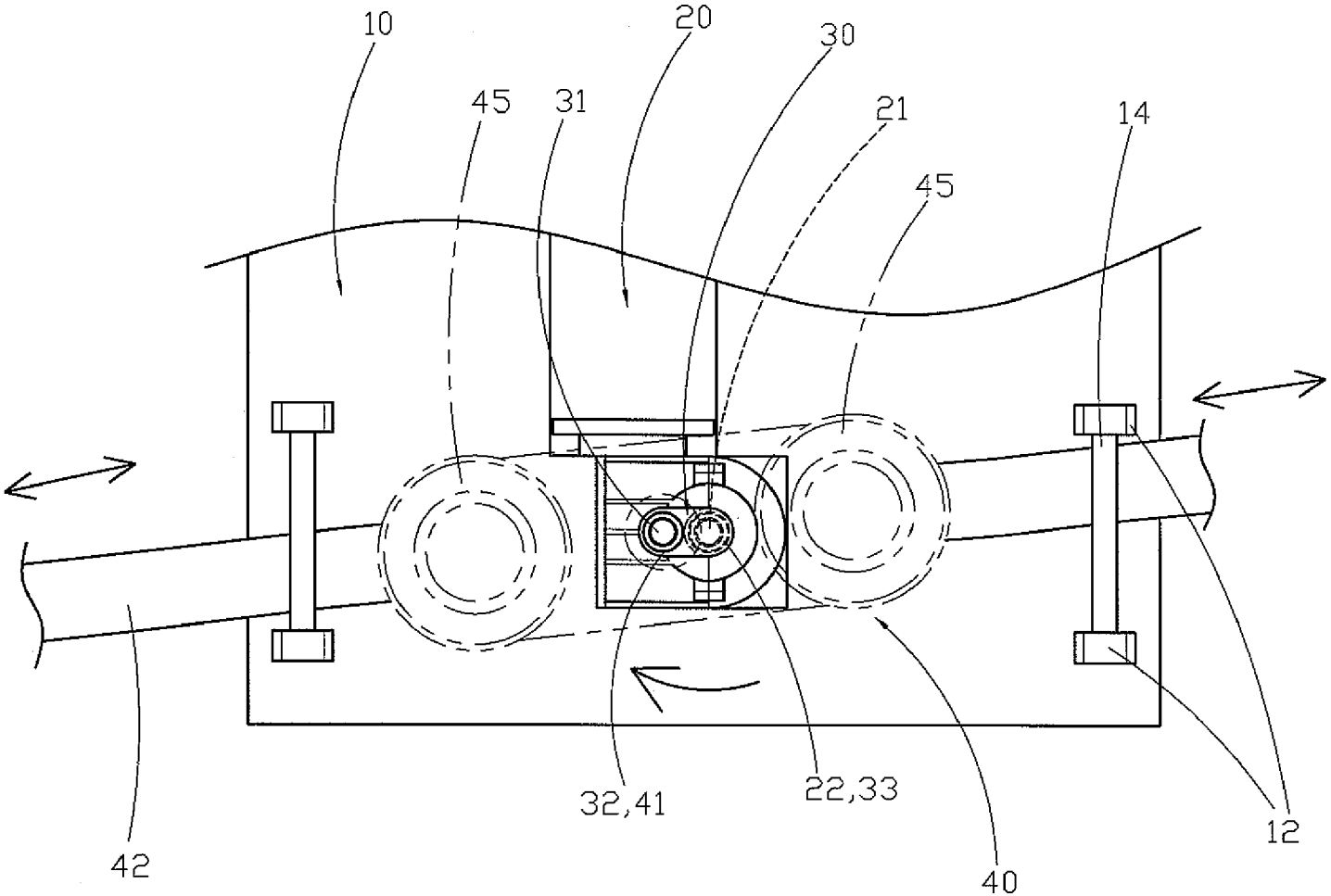
FIG. 8 is a schematic operational view of the massaging device as shown in FIG. 7.
Figure 9:
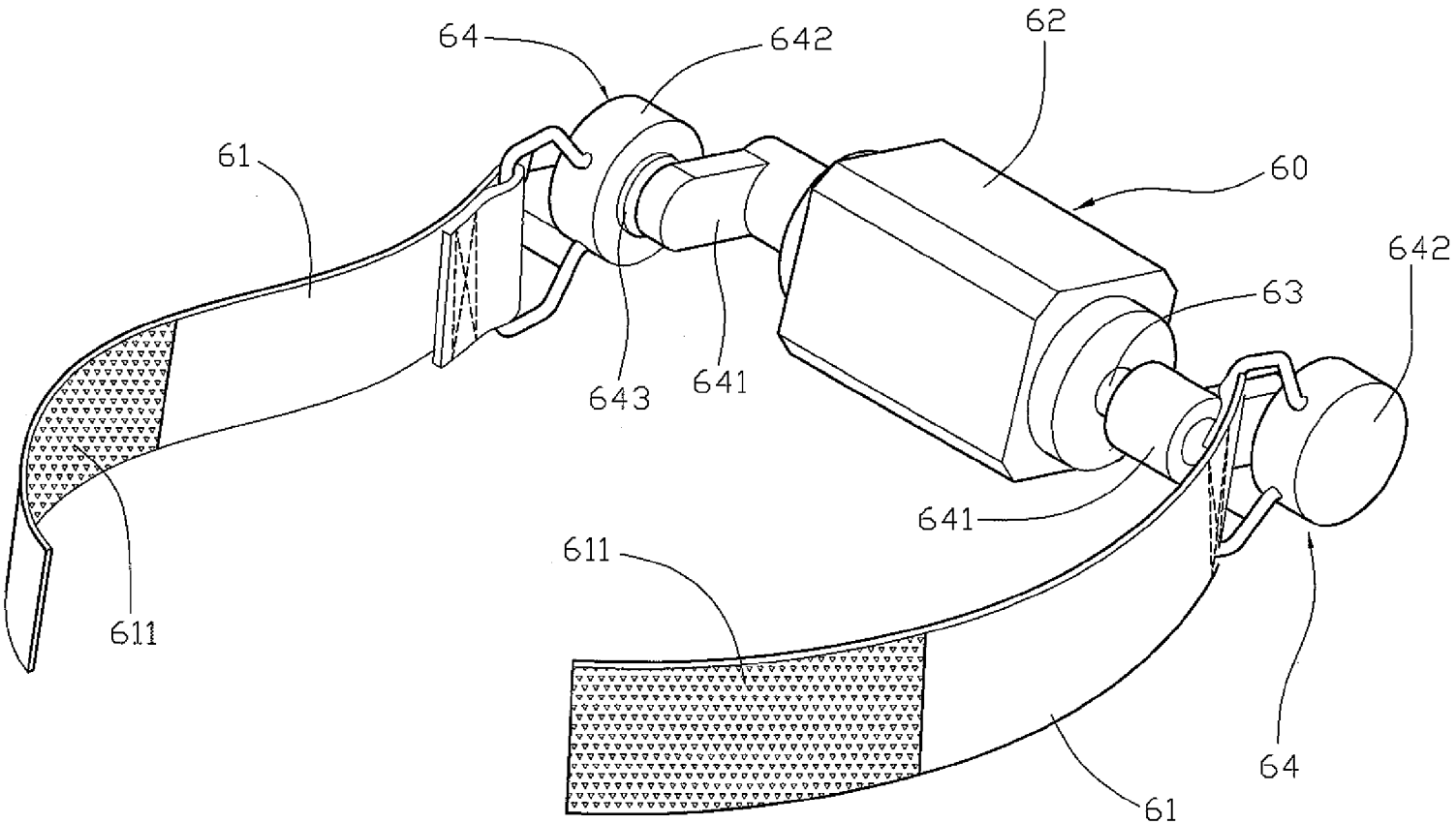
FIG. 9 PRIOR ART
FIG. 9 is a perspective view of a conventional massaging device in accordance with the prior art.
Figure 10:
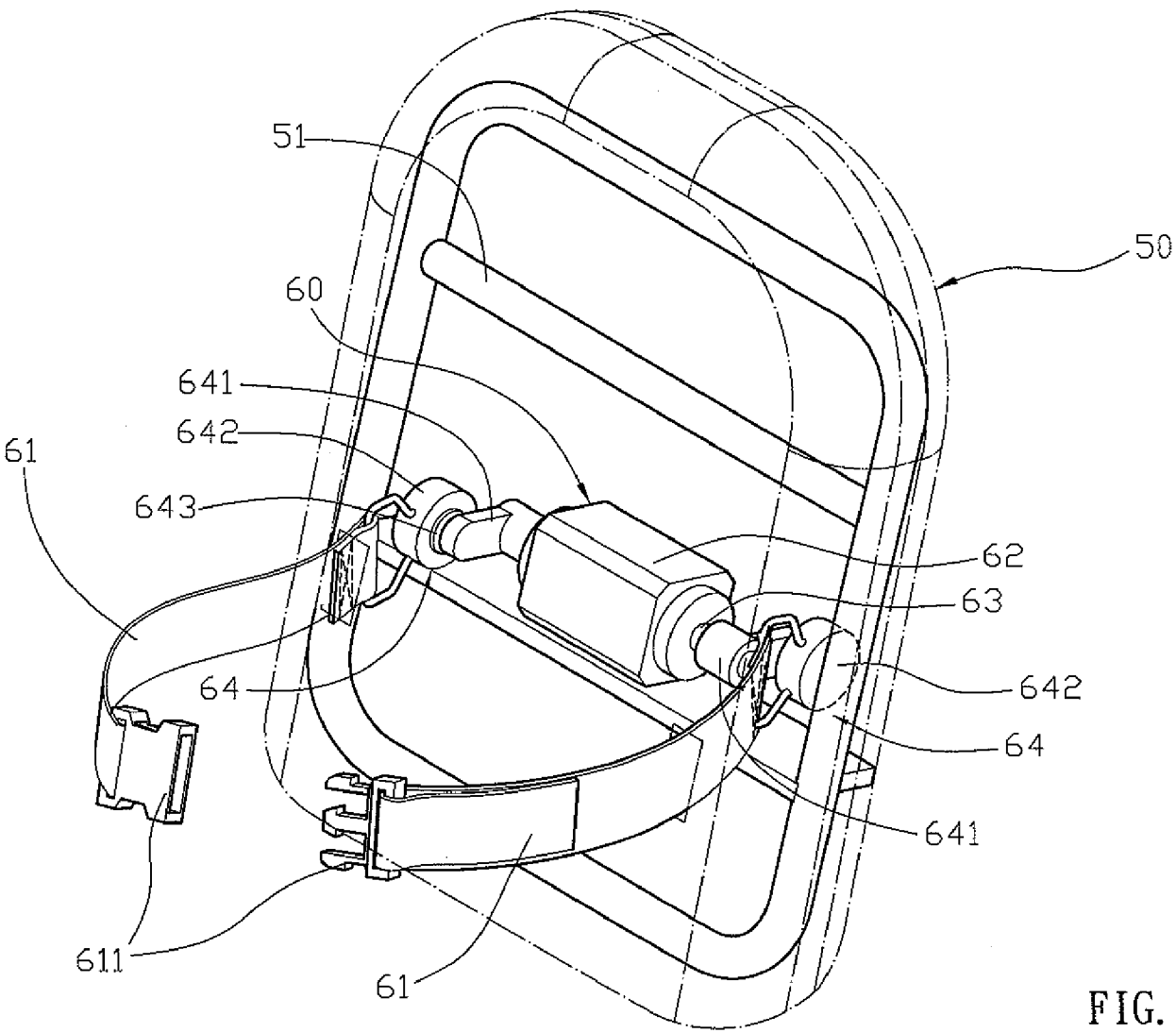
FIG. 10 PRIOR ART
FIG. 10 is a perspective enlarged view of the conventional massaging device as shown in FIG. 9.

On the other hand, referring to FIGS. 6-8 with reference to FIGS. 1-5, the massaging member 40 is driven by the eccentric shaft 31 of the eccentric member 30 to move downward, leftward, upward and rightward relative to the support member 10 in a reciprocal manner, so that the two connecting straps 42 are movable downward, leftward, upward and rightward relative to the two support rods 14 in a reciprocal manner as shown in FIGS. 6-8, and the two massaging belts 43 are movable downward, leftward, upward and rightward relative to the user's body in a reciprocal manner, so as to massage the user's body reciprocally.

Accordingly, the massaging member 40 is movable to massage the user's back reciprocally, and the two massaging belts 43 are movable to massage the user's body reciprocally, so that the massaging device can be used to massage the user's body exactly and completely, thereby enhancing the massaging effect of the massaging device, and thereby providing comfortable sensation to the user. In addition, the user's body is encircled by the two massaging belts 43, the two connecting straps 42 and the massaging member 40, so that the user's body is pulled, rubbed, twisted and kneaded by movement and deflection of the two massaging belts 43, the two connecting straps 42 and the massaging member 40, thereby greatly enhancing the massaging effect of the massaging device. Further, the massaging member 40 can be used to massage the user's back, and the two massaging belts 43 can be used to massage the user's waist and abdomen, thereby enhancing the versatility of the massaging device.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A massaging device, comprising:

a support member;

a massaging member movably mounted on the support member;

two opposite connecting straps connected with the massaging member respectively;

two massaging belts combined with each other and each connected with a respective one of the two connecting straps;

a drive member mounted on the support member and provided with a rotation shaft;

an eccentric member mounted on and rotatable with the rotation shaft of the drive member and provided with an eccentric shaft connected with the massaging member to drive the massaging member to move relative to the support member by rotation of the eccentric member.

2. The massaging device in accordance with claim 1, further comprising:

two support rods each mounted on the support member and each abutting a respective one of the two connecting straps.

3. The massaging device in accordance with claim 2, wherein the support member has two opposite ends each provided with two spaced support blocks to support a respective one of the two support rods.

4. The massaging device in accordance with claim 1, wherein the massaging member has a middle portion provided with a driven hole to receive the eccentric shaft of the eccentric member.

5. The massaging device in accordance with claim 4, wherein the eccentric shaft of the eccentric member is rotatably mounted in the driven hole of the massaging member to move the massaging member by rotation of the eccentric member.

6. The massaging device in accordance with claim 4, wherein the driven hole of the massaging member has a stepped shape.

7. The massaging device in accordance with claim 4, wherein the massaging member has a surface provided with two spaced massaging rolls;

the driven hole of the massaging member is located between the two massaging rolls.

8. The massaging device in accordance with claim 4, further comprising:

a bearing mounted in the driven hole of the massaging member and located between the massaging member and the eccentric shaft of the eccentric member.

9. The massaging device in accordance with claim 1, wherein the eccentric member has a first end secured on and rotatable with the rotation shaft of the drive member and a second end provided with the eccentric shaft.

10. The massaging device in accordance with claim 9, wherein the first end of the eccentric member is provided with a mounting hole mounted on the rotation shaft of the drive member;

the massaging device further comprises a bushing mounted in the mounting hole of the eccentric member and located between the eccentric member and the rotation shaft of the drive member.

11. The massaging device in accordance with claim 2, wherein each of the two connecting straps is movable between the support member and the respective support rod.

12. The massaging device in accordance with claim 11, wherein each of the two connecting straps has a first end connected with one of two opposite ends of the massaging member;

each of the two massaging belts has a first end connected with a second end of the respective connecting strap and a second end provided with an adjustable bonding portion.

13. The massaging device in accordance with claim 1, wherein the two massaging belts, the two connecting straps and the massaging member form a loop when the two massaging belts are combined with each other.

14. The massaging device in accordance with claim 2, wherein the massaging member is located between the two support rods;

each of the two massaging belts is located outside of the respective support rod.

15. The massaging device in accordance with claim 1, wherein the eccentric shaft of the eccentric member has an axial direction spaced from and parallel with that of the rotation shaft of the drive member.

16. The massaging device in accordance with claim 2, wherein the support member has a mediate portion provided with a receiving recess located between the two support rods to receive the drive member and the eccentric member.

17. The massaging device in accordance with claim 3, further comprising:

two positioning bolts each extending through the respective support blocks of the support member and the respective support rod to position the respective support rod between the respective support blocks of the support member.

18. The massaging device in accordance with claim 2, wherein each of the two support rods is a hollow body.

19. The massaging device in accordance with claim 3, wherein each of the two support rods is rotatably mounted between the respective support blocks of the support member.

20. The massaging device in accordance with claim 1, wherein the drive member includes a gear unit engaged with the rotation shaft to rotate the rotation shaft, and a motor connected with the gear unit to drive the gear unit;

the gear unit includes a reduction gear to increase a torque of the drive member.

* * * * *